US011417991B2

(12) United States Patent
Norris

(10) Patent No.: US 11,417,991 B2
(45) Date of Patent: Aug. 16, 2022

(54) RETAINER RESISTING DECOUPLING OF ELECTRICAL CORDS

(71) Applicant: Jason Robert Norris, Windsor, CO (US)

(72) Inventor: Jason Robert Norris, Windsor, CO (US)

( * ) Notice: Subject to any disclaimer, the term of this patent is extended or adjusted under 35 U.S.C. 154(b) by 0 days.

(21) Appl. No.: 17/227,830

(22) Filed: Apr. 12, 2021

(65) Prior Publication Data

US 2021/0320458 A1 Oct. 14, 2021

Related U.S. Application Data

(60) Provisional application No. 63/101,008, filed on Apr. 13, 2020.

(51) Int. Cl.
*H01R 13/639* (2006.01)
*H01R 13/52* (2006.01)
*H01R 13/58* (2006.01)

(52) U.S. Cl.
CPC ..... *H01R 13/6392* (2013.01); *H01R 13/521* (2013.01); *H01R 13/5804* (2013.01)

(58) Field of Classification Search
CPC ..... H01R 13/6392; H01R 13/521; H01R 13/5205; H01R 13/5804
See application file for complete search history.

(56) References Cited

U.S. PATENT DOCUMENTS 3,014,194 A * 12/1961 Berglund ..... H01R 13/6392 174/DIG. 11
3,030,601 A * 4/1962 Krebs ..... H01R 13/6392 439/367
3,120,987 A 2/1964 Degnan et al.
3,181,105 A 4/1965 Roach et al.
4,143,934 A * 3/1979 Siebert ..... H01R 13/6392 439/369
4,643,505 A * 2/1987 House ..... H01R 13/6392 439/267
5,110,303 A * 5/1992 Hardy ..... H01R 13/6395 439/367
5,306,176 A 4/1994 Coffey
5,431,583 A 7/1995 Szegda
5,735,704 A 4/1998 Anthony
(Continued)

OTHER PUBLICATIONS

U.S. Appl. No. 63/101,008, filed Apr. 13, 2020.

*Primary Examiner* — Travis S Chambers
(74) *Attorney, Agent, or Firm* — Craig R. Miles; CR Miles P.C.

(57) ABSTRACT

A retainer resists decoupling of a first connector of a first cord from a second connector of a second cord. The retainer includes a first receiver having an adjuster to adjust the receiver about a portion of the first cord. The retainer includes a second receiver having an adjuster to adjust the receiver about a portion of the second cord. A connector housing couples the first and second receiver. The first receiver, second receiver, and connector housing form a continuous chamber in which lies portion of the first and second cords connected together when the retainer resides in an installed orientation. The retainer, in the installed orientation, resists incursion of water, dust particulate matter and other debris into the continuous chamber.

17 Claims, 11 Drawing Sheets

(56) References Cited

U.S. PATENT DOCUMENTS

| | | | | |
|---|---|---|---|---|
| 6,036,526 | A * | 3/2000 | Alfis, III | H01R 4/70 439/369 |
| 6,997,734 | B1 * | 2/2006 | McQuirter | H01R 13/6392 439/369 |
| 7,001,202 | B2 * | 2/2006 | Robbins | H01R 13/6271 439/367 |
| 7,285,725 | B1 * | 10/2007 | Saman | H01R 13/6392 174/92 |
| 9,899,823 | B1 | 2/2018 | Catinis | |
| 10,164,416 | B2 * | 12/2018 | Nooner | H02G 15/10 |
| 10,923,851 | B2 * | 2/2021 | Betterridge | H01R 13/501 |

* cited by examiner

RETAINER RESISTING DECOUPLING OF ELECTRICAL CORDS

This United States Non-Provisional Patent application claims the benefit of U.S. Provisional Patent Application No. 63/101,008, filed Apr. 13, 2020, hereby incorporated by reference herein.

I. FIELD OF THE INVENTION

The present disclosure concerns a retainer to resist decoupling of a first connector of a first cord from a second connector of a second cord.

II. BACKGROUND OF THE INVENTION

U.S. Pat. No. 3,120,987, Paul Degnan et al., concerns a detachable electrical connector for an electrical cord. The device includes two detachable connector components. Each connector component has a body; electrical contact means carried by each body and arranged to be brought into engagement on said connector components being moved longitudinally toward each other. Each of the bodies are arranged to have a separate electrical cord section connected to its contact means.

U.S. Pat. No. 3,181,105, Melvin Denney et al., concerns a connector attachable between a pair of cable ends having a plurality of conductors. The connector has a pair of body means. Each of the body means having a passage therein for receiving a cable end therethrough. Each of the body means have longitudinally extending chamber. Further a terminal support member fits snugly in each of the chambers. Also, a plurality of terminal receiving chambers is in each of the terminal support members. The terminal receiving chambers in one terminal support member aligning axially with terminal receiving chambers in the other terminal support member. Electrical sockets are placed in the terminal receiving chambers in one the terminal support members. Electrical pins are placed in the terminal receiving chambers in the other terminal support member.

U.S. Pat. No. 5,306,176, Eugene Coffey, concerns a protector for protecting the mating plug and socket of connected electrical cords from damage and contamination and which allows quick disconnection of the plug and socket in an isolated chamber. The protector has a tubular housing formed of high impact plastic, preferably transparent, which surrounds the mating plug and socket members of connected electrical cords and resilient end plugs which are slidably received on the cords rearwardly of the plug and socket. The end plugs have a longitudinal slit extending radially from a central longitudinal bore and are installed by pressing them laterally onto the cords then sliding them axially on the cords to press them into the open ends of the tubular housing. When pressed into the ends of the housing, the end plugs define a central chamber surrounding the plug and socket connection and form a seal at the opposed ends of the chamber between the housing and the exterior of the cords. The coefficient of friction between the end plugs and interior of the housing is greater than the coefficient of friction between the end plugs and the cords such that the end plugs remain frictionally engaged with the interior of the housing while allowing relative sliding movement between the cords and end plugs. When the cords are pulled apart, the plug and socket separate completely while enclosed in the sealed chamber to isolate any spark or arc and continued axial movement pulls the end plugs from the ends of the housing.

U.S. Pat. No. 5,431,583, Andrew Szegda, concerns a male splice adaptor having a tubular housing having first and second sections which are detachably coupled to one another. Each of the sections includes an output port from which a connector pin extends from within the housing. A seal is provided in each of the output ports and is configured so that as the first and second sections are coupled to one another, the seal is expanded so as to create a weather-tight seal within the output port.

U.S. Pat. No. 5,735,704, John Anthony, concerns a shroud seal having an annular ring portion and an annular lip portion. The annular ring portion is installed on the shroud of an electrical connector such that the annular lip portion is axially compressed on the shroud by a mating shrouded electrical connector. The annular ring portion has a frustoconical inner sealing surface which is sized to be twisted from its original molded frustoconical form to a cylindrical form when installed around the shroud of the electrical connector. This twisting of the shroud seal produces a concentrated hoop stress in the seal at its points of contact with the shroud. The annular ring portion and the lip portion are compliant to allow for large axial tolerance variations between the mating electrical connectors and provides for low insertion force between the mating electrical connector. The electrical connector can be in the form of a plug having a tubular portion or seal guard for encircling the shroud seal to protect the seal.

III. SUMMARY OF THE INVENTION

One aspect of the invention provides a retainer to resist decoupling of a first connector of a first cord from a second connector of a second cord. The retainer includes a first receiver having a contact surface and an adjuster which in cooperation enable adjustment of the first receiver from an uncoupled orientation into a fixedly coupled orientation with the first cord. The retainer further includes a second receiver having a contact surface and an adjuster which in cooperation enabling adjustment of said second receiver from and uncoupled orientation into a fixedly coupled orientation with said second cord. The first receiver is connected to the second receiver. The retainer when in the installed orientation has its first receiver residing in the fixedly coupled orientation with the first cord. The first cord resides in the first receiver. Also, the second receiver resides in the fixedly coupled orientation with the second cord. The second cord resides in the second receiver. The retainer resists decoupling of the first connector from said second connector. The retainer of claim can resist decoupling of said first connector of said first cord from said second connector of said second cord when said retainer subjected to fifteen (15) pounds of force applied through the first cord or the second cord to the retainer in a decoupling direction.

The adjuster of the first receiver and the adjuster of the second receiver can each comprise a fastener. The fastener can include a holdfast. The adjuster of the first receiver and the adjuster of the second receiver can each have structure selected from a group of structures consisting of: a hook, a loop, a snap, a strap, interlocking ridges, a plurality of interlocking teeth, a slider, a clasp, a zipper, an interlocking track and groove, a ratchet, teeth engageable with a pawl, a pawl insertable into delimited open spaces, hooks which couple to loops, interlocking ridges, and combinations thereof.

The retainer can include a first seal, wherein when the retainer resides in the installed orientation, the first cord resides in a space delimited by the first seal. A contact surface of the first receiver resides disposed about said first seal. The retainer can further include a second seal, wherein when the retainer resides in the installed orientation, the second cord resides in a space delimited by the second seal. A contact surface of said second receiver disposed about said second seal.

A housing to receive the first and second connectors can interconnect the first receiver to said second receiver. The housing can include an adjuster having structure selected from a group of structures consisting of a hook, a loop, a snap, a strap, interlocking ridges, a plurality of interlocking teeth, a slider, a clasp, a zipper, an interlocking track and groove, a ratchet, teeth engageable with a pawl, a pawl insertable into delimited open spaces, hooks which couple to loops, and combinations thereof. Both the first receiver adjuster and second receiver adjuster each can share structure with the housing adjuster. When the retainer is in the installed orientation, said housing envelopes the first connector of the first cord and the second connector of second cord.

The first receiver, the second receiver, and connecting housing can comprise an integrated jacket. The integrated jacket can comprise an elastomeric material. The first receiver and second receiver can comprise rubber. The contact surface of said first receiver and second receiver can comprise a tactile surface. The integrated jacket without an opening therethrough when the retainer in said installed orientation. Wherein when the retainer resides in the installed orientation, the integrated jacket delimits an interior chamber, and in the chamber, reside the first connector of the first cord and a cord portion of said first cord adjacent said first connector; and the second connector of the second cord and a cord portion of said second cord adjacent said second connector. The retainer resists incursion of water into said interior chamber.

Naturally, further objects of the invention are disclosed throughout other areas of the specification, drawings, photographs, and claims.

IV. BRIEF DESCRIPTION OF THE DRAWINGS

FIG. 1A is a top view of a retainer having a first receiver and its adjuster in an installed orientation relative to a first cord portion of a first cord; a second receiver and its adjuster in an uninstalled orientation relative to a second cord portion of a second cord; a ridged contact surface of the second receiver partially about a second seal of the retainer; a connector housing and its adjuster in an uninstalled orientation relative to a first and second connector plugged with each other.

Figure 1A:
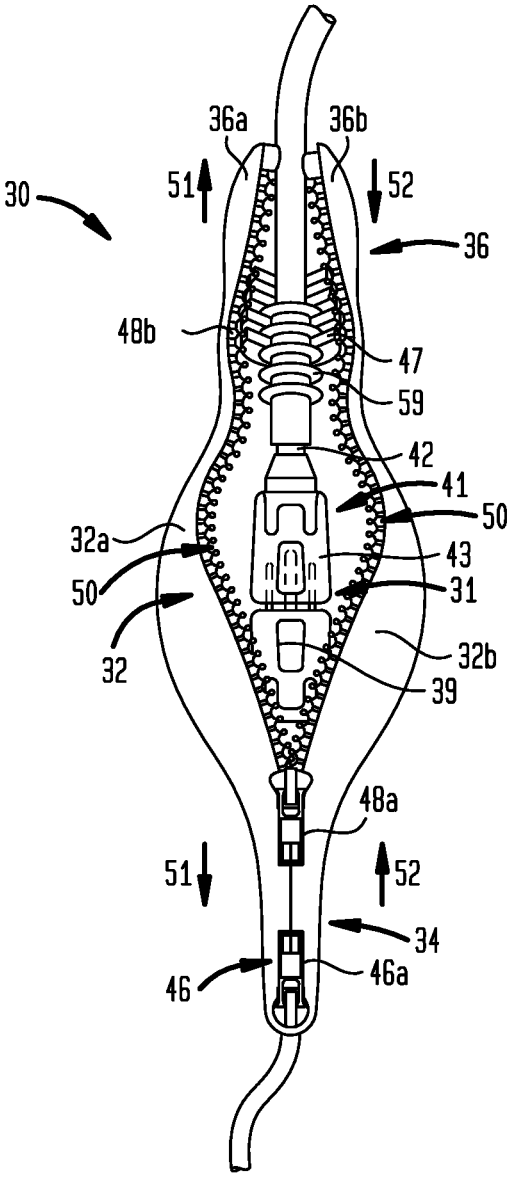
FIG. 1B is a blown-up view of the second receiver of the retainer shown in FIG. 1A.
FIG. 1C is a view of the second cord shown in FIG. 1.
Figure 1B:
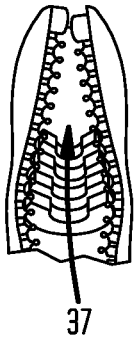
Figure 1C:
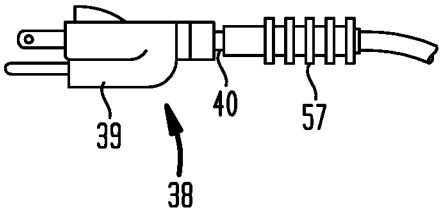
Figure 2:
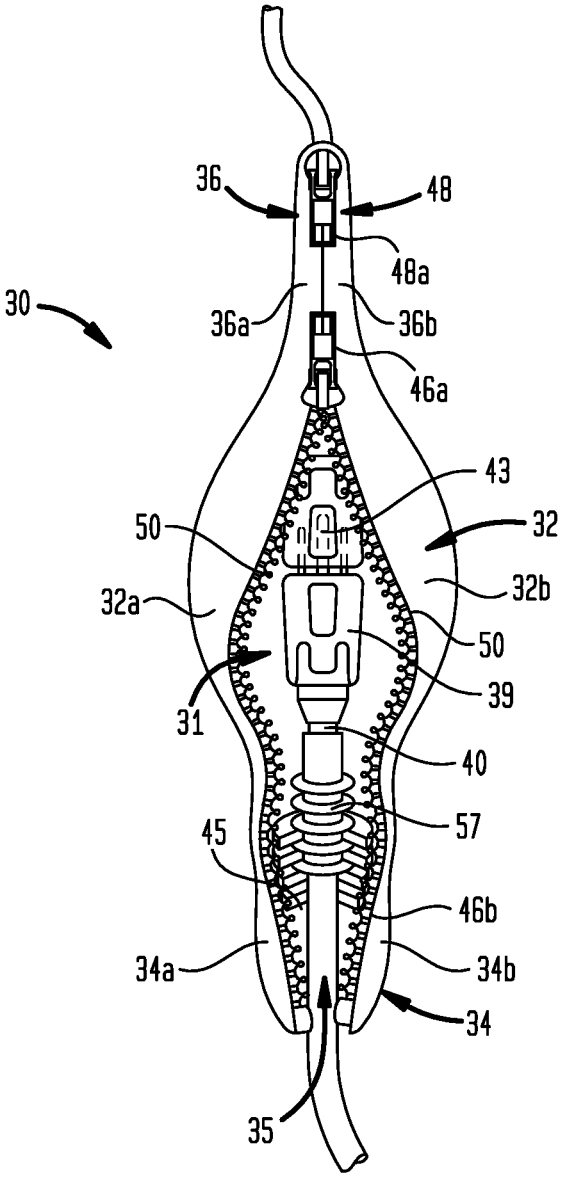

FIG. 2 is a top view of the retainer of FIG. 1 having the first receiver and its adjuster in an uninstalled orientation relative to a first cord portion of a first cord; a ridged contact surface of the first receiver partially about a first seal of the retainer; a second receiver and its adjuster in an installed orientation relative to a second cord portion of a second cord; a connector housing and its adjuster in an uninstalled orientation relative to the first and second connector plugged with each other.

Figure 3:
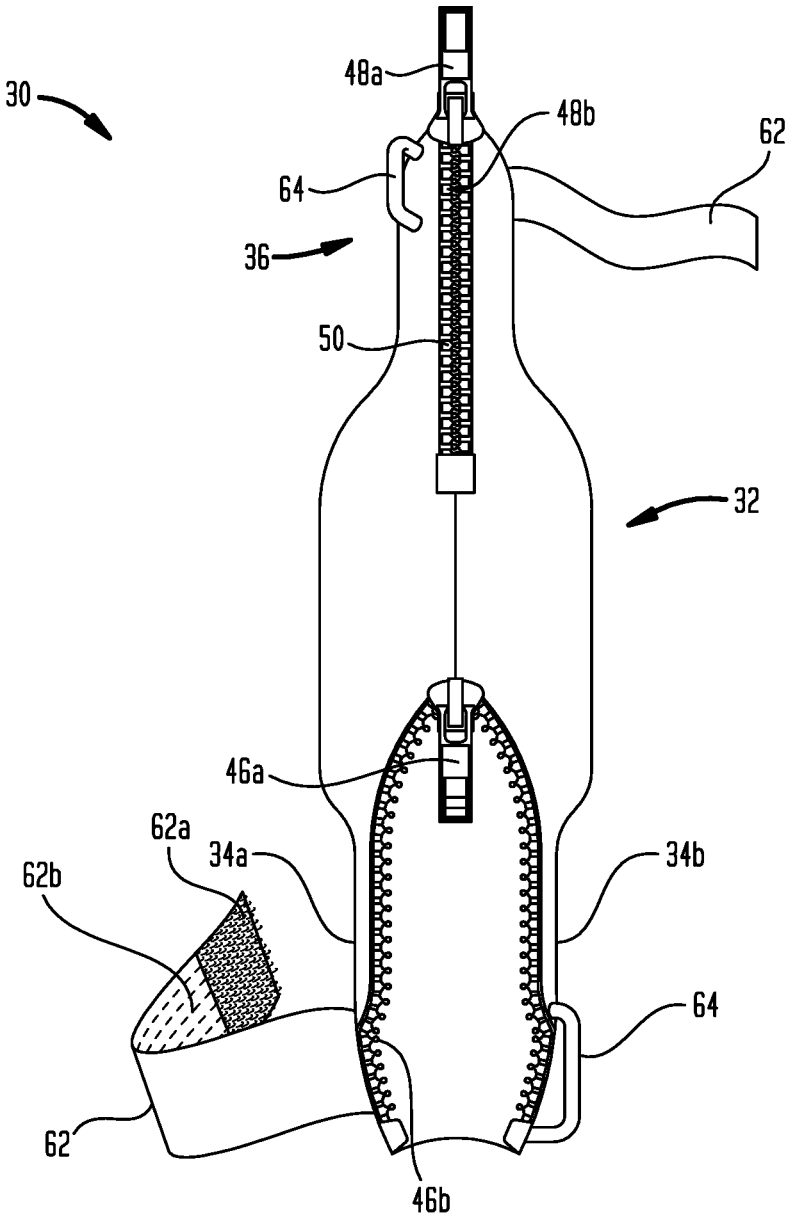

FIG. 3 is a top view of an alternative embodiment of the retainer shown in FIG. 1 exclusive of the first and second cords; the retainer of FIG. 1 having the first receiver and its adjuster in an open uninstalled orientation; the second receiver and its adjuster in a partially closed installed orientation; the connector housing and its adjuster in a partially installed orientation.

Figure 4A:
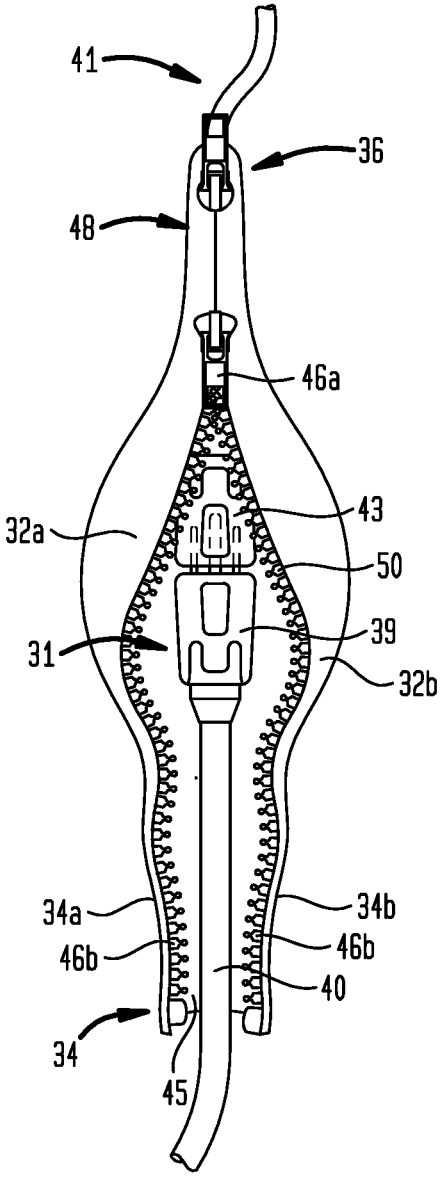

FIG. 4A is a top view of an alternative embodiment of the retainer of FIG. 1 having the first receiver and its adjuster in an uninstalled orientation relative to the first cord portion of the first cord; an unridged contact surface of the first receiver partially about the first cord portion; the second receiver and its adjuster in an installed orientation relative to the second cord portion of the second cord; the connector housing and its adjuster in an uninstalled orientation relative to the first and second connector plugged with each other.

Figure 4B:
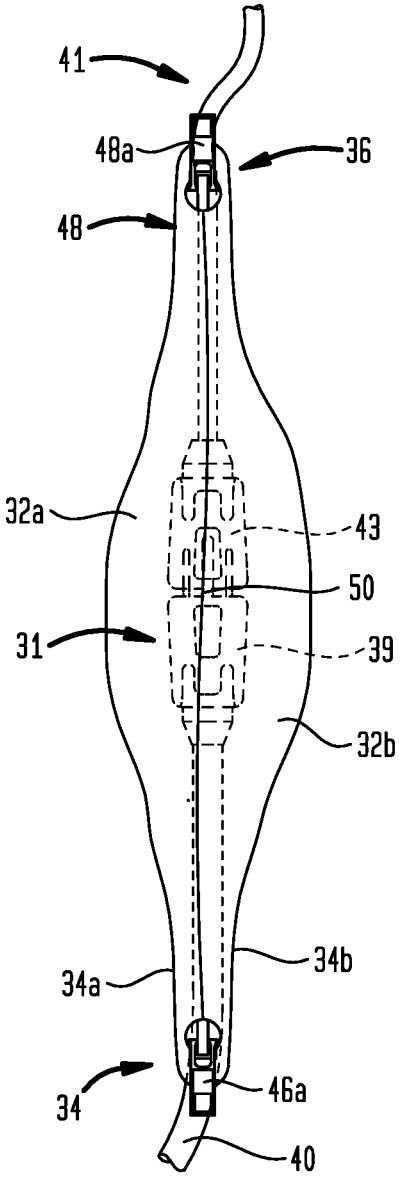

FIG. 4B is a top view of the retainer of FIG. 4A having the first receiver and its adjuster in an installed orientation relative to the first cord portion of the first cord; the second receiver and its adjuster in an installed orientation relative to the second cord portion of the second cord; the connector housing and its adjuster in an installed orientation relative to the first and second connector plugged with each other.

Figure 5:
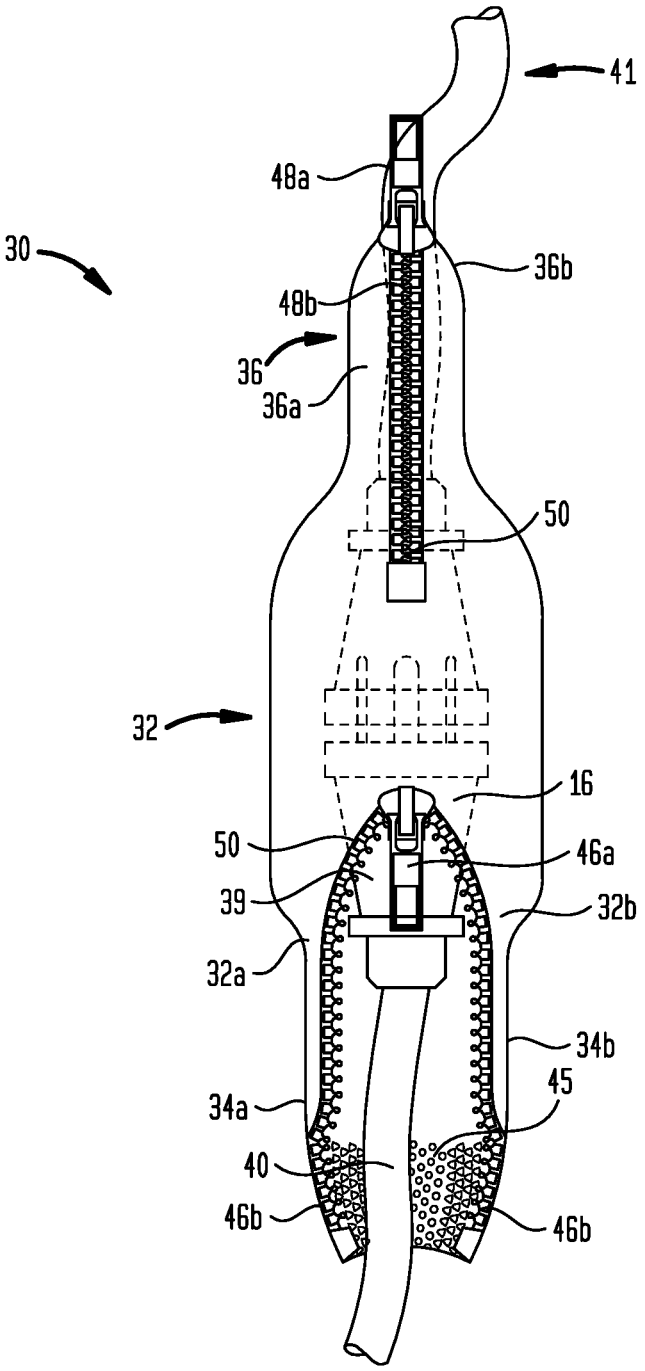

FIG. 5 is a top view of an alternative embodiment of the retainer of FIG. 3 having the first receiver and its adjuster in an uninstalled orientation relative to the first cord portion of the first cord; a contact surface having projections of the first receiver partially about the first cord portion; the second receiver and its adjuster in an installed orientation relative to the second cord portion of the second cord; the connector housing and its adjuster in an uninstalled orientation relative to the first and second connector plugged with each other.

Figure 6:
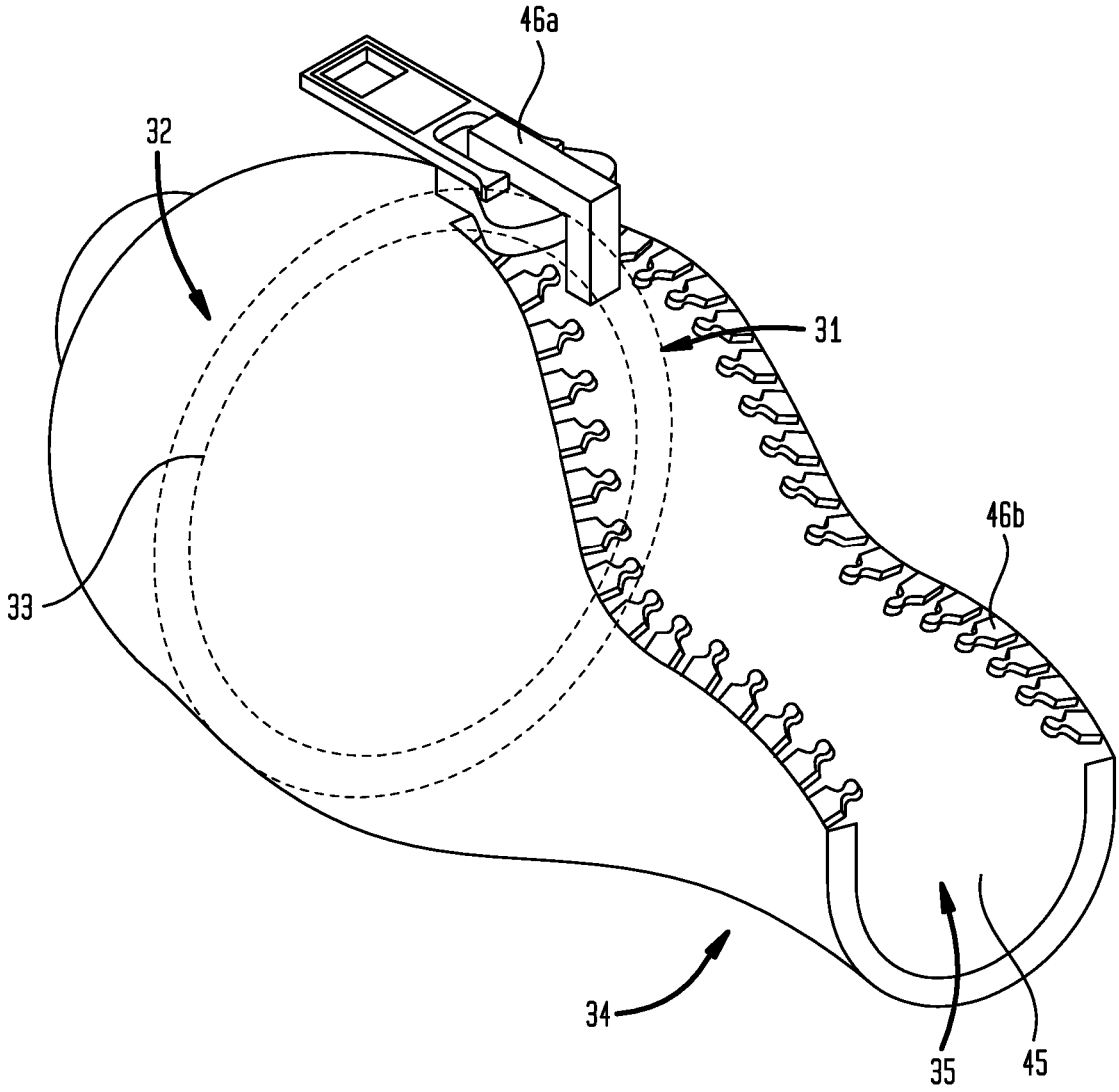

FIG. 6 is an end view of an alternative embodiment of the retainer of FIG. 5 looking into the first receiver; the connector housing reinforced with an interior hardened surface to prevent crush of the connectors.

Figure 7A:
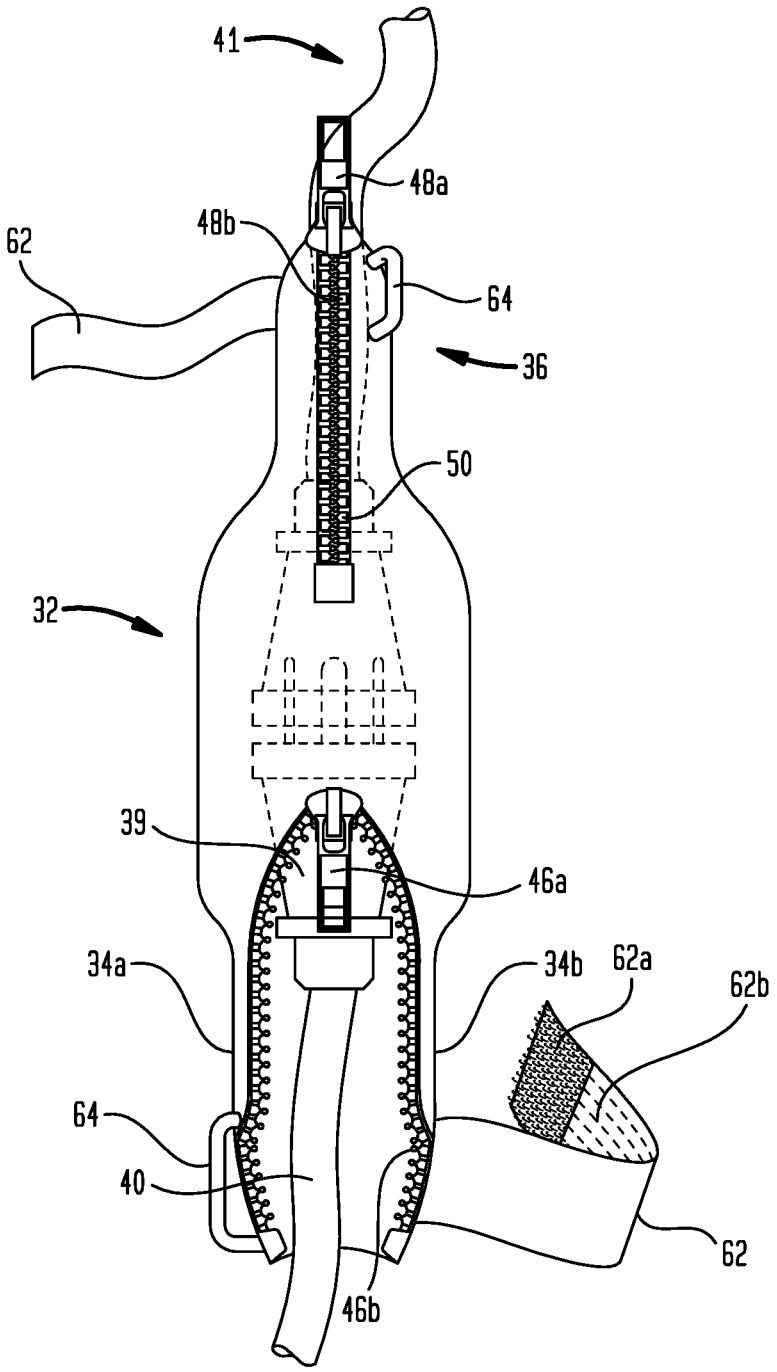

FIG. 7A is a top view of an alternative embodiment of the retainer of FIG. 6 having the first receiver and its adjuster in an uninstalled orientation relative to the first cord portion of the first cord; a contact surface of the first receiver resides partially about the first cord portion; the second receiver and its adjuster in a partially installed orientation relative to the second cord portion of the second cord; the first receiver adjuster and second receiver adjuster each comprising a strap and loop; the connector housing and its adjuster in an uninstalled orientation relative to the first and second connector plugged with each other.

Figure 7B:
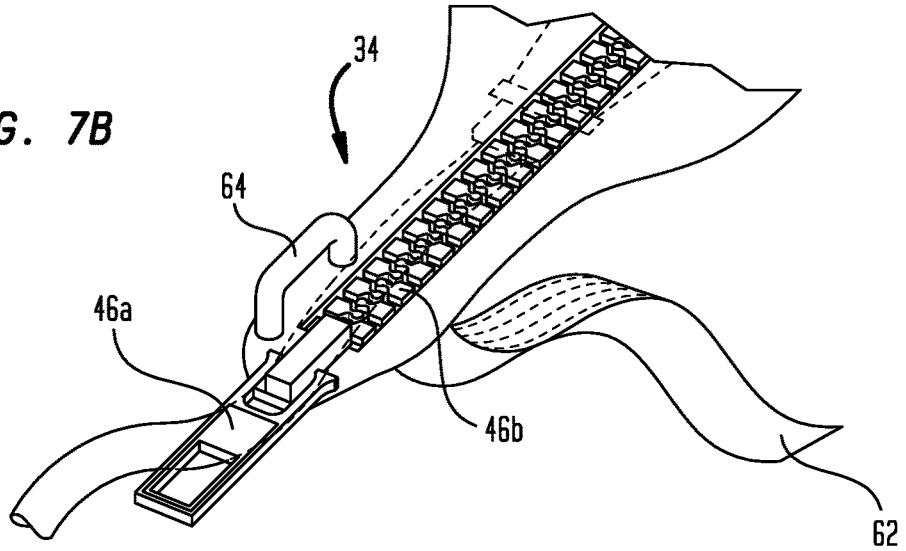
Figure 7C:
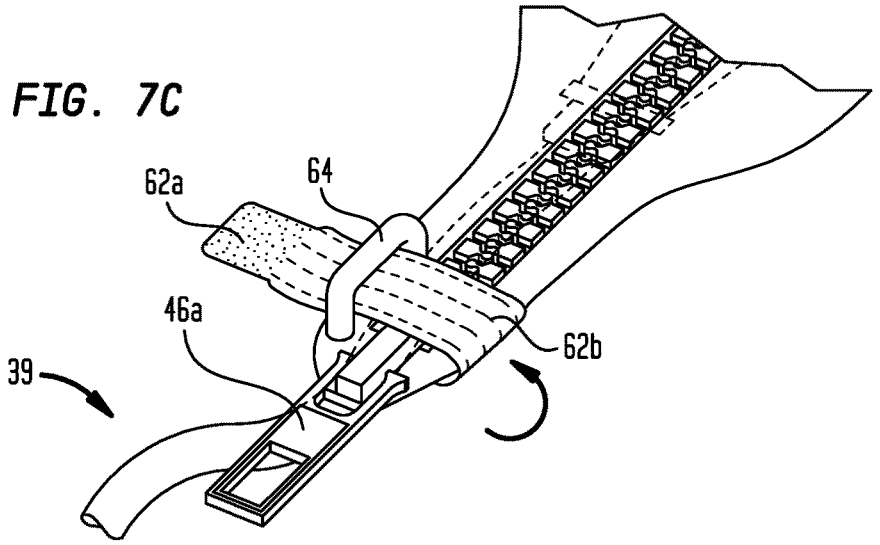
Figure 7D:
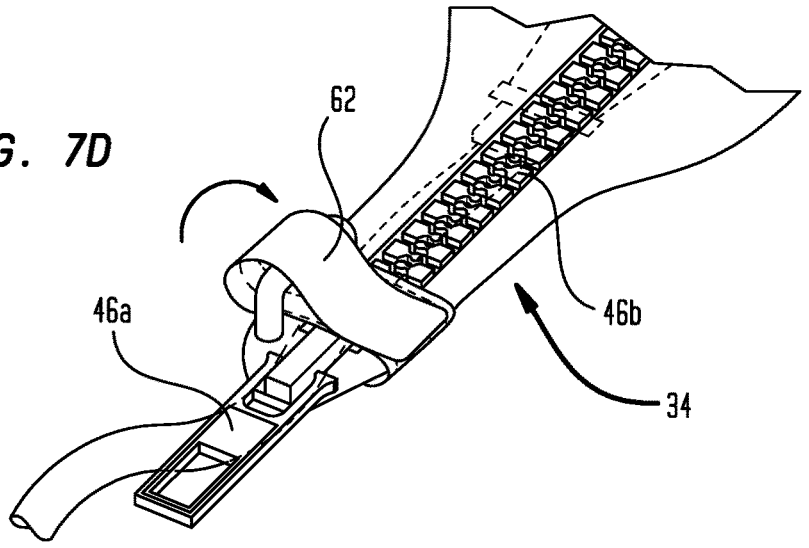
Figure 8A:
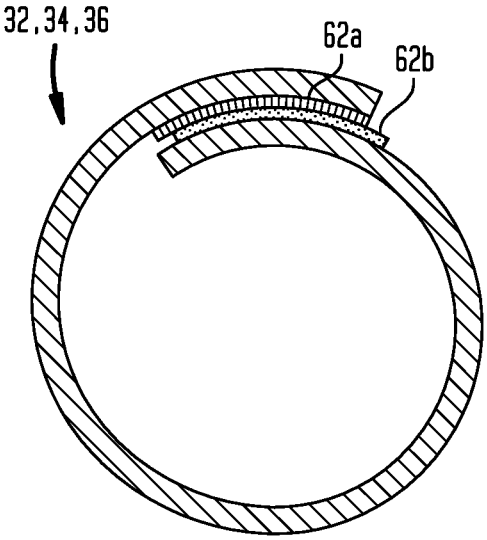
Figure 8B:
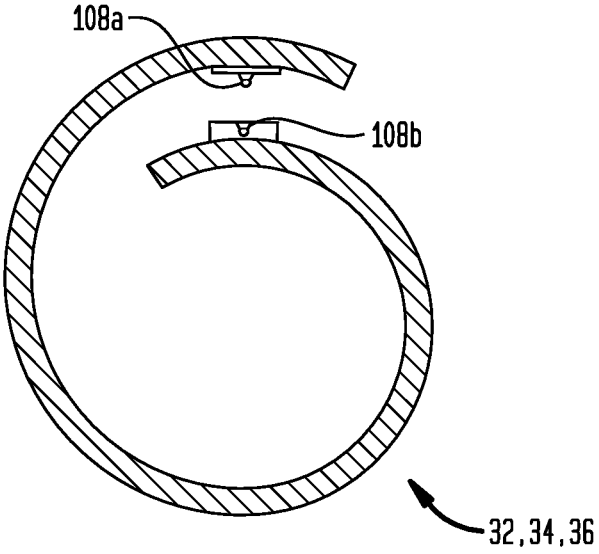
Figure 8C:
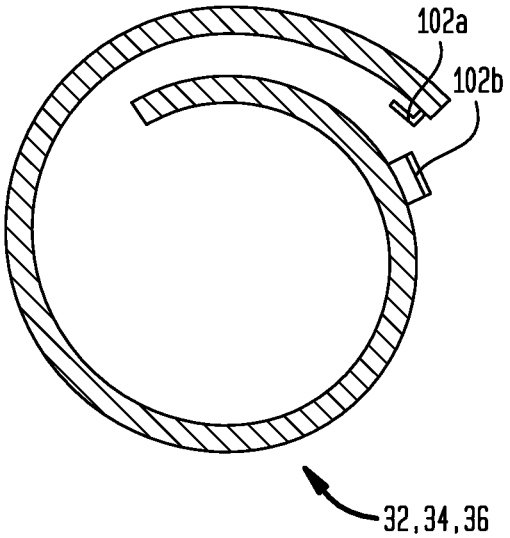
Figure 8D:
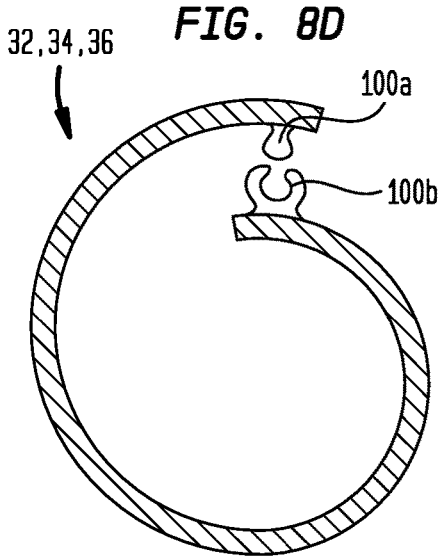
Figure 8E:
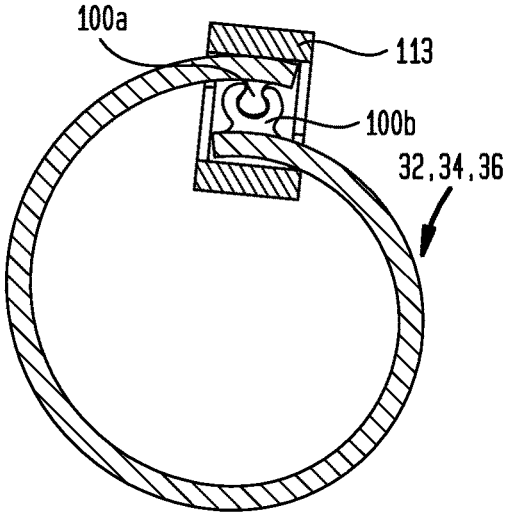
Figure 8F:
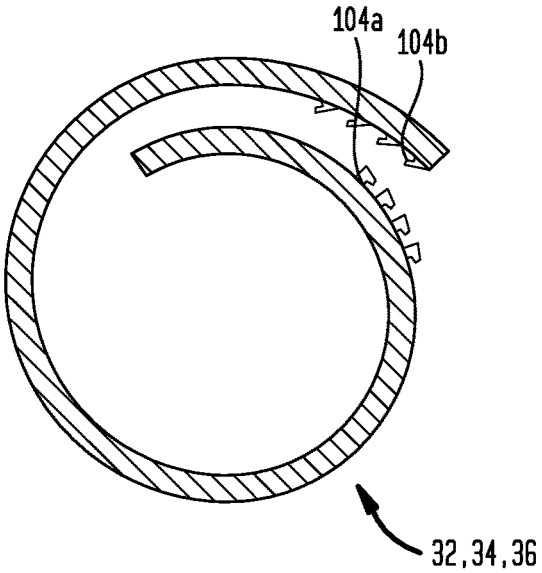
Figure 8G:
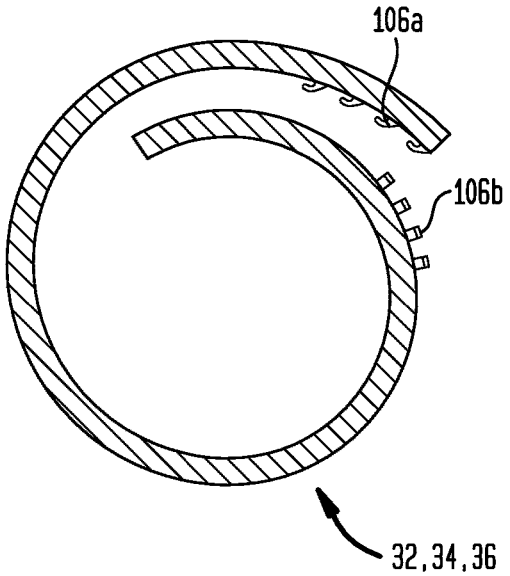
Figure 8H:
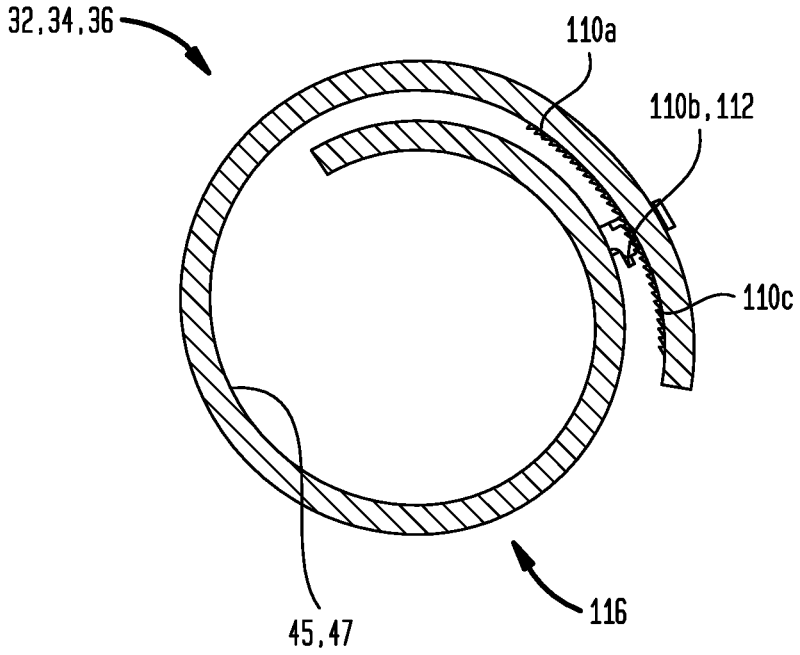

FIGS. 7B-7D is a top view of the adjuster of the second receiver showing the strap orienting from the unstrapped orientation to an installed orientation relative to the second cord portion.

FIGS. 8A-8H show a representative stripped down cross-sectional view of the first receiver, second receiver, or connector housing having various types of adjusters.

V. DETAILED DESCRIPTION OF THE INVENTION

Generally, referring to FIGS. 1 through 8F, in one embodiment of the invention a retainer (30), in an installed orientation, is configured to fixedly and to removably couple to a first cord (38) having a first connector (39) and a second cord (41) having a second connector (43). The first connector plugged with or into the second connector. The retainer (30) resists the first connector (39) from decoupling, more particularly de-plugging, and even more particularly unplugging from the second connector (43). Further the retainer (30) weatherizes the connectors (39, 43) when they are in a plugged relationship. The weatherization includes preventing the incursion of water in a chamber delimited by the retainer when the retainer resides in an installed orientation.

It also prevents the incursion of dust, dirt, particulate matter, and other debris from entering the chamber when the retainer resides in the installed orientation. The chamber houses the first and second connectors.

In more detail the retainer (30) has a connector housing (32) which connects a first receiver (34) and a second receiver (36). In the retainer installed orientation, the first receiver (34), second receiver (36), and connector housing (32) each delimit a chamber (37, 35, 31). The first connector (39) plugged with, more particularly plugged into, the second connector (43) resides in the connector housing chamber (31). A first cord portion (40) of the first cord (38), downstream the first connector (39) and adjacent the first connector (39), fixedly resides in the first receiver chamber (35). The first cord portion can include a stress relief at the first connector. A second cord portion (42) of the second cord (41), downstream the second connector (43) and adjacent the second connector (43), fixedly resides in the second receiver chamber (37). The second cord portion can include a stress relief at the second connector. The retainer (30) resists unplugging of the first connector (39) from the second connector (43). The retainer (30) also resists the incursion of water into the chambers and generally weatherproofs the connectors (39, 43) from the elements. The retainer (30) also prevents the incursion of dust, dirt, particulate matter, and other debris from entering the chambers (31, 35, 37) when the retainer resides in the installed orientation.

In more detail the first (34) and second receiver (36) each have a contact surface (45, 47) and an adjuster (46, 48). In cooperation, the contact surface (45) and adjuster (46) of the first receiver (34) enable adjustment of the first receiver (34) from an uncoupled orientation into the fixedly coupled orientation with the first cord portion (40). In cooperation, the contact surface (47) and adjuster (48) of the second receiver (36) enable adjustment of the second receiver (36) from an uncoupled orientation into a fixedly coupled orientation with the second cord portion (42). The connector housing (32) can also have an adjuster (50) enabling complete closing of the housing chamber (31). The adjusters (46, 48, 50) can include various structures. For instance, the structures can include a hook (62*a*), a loop (62*b*; 64), a snap (100*a*, 100*b*), a strap (62), a plurality of interlocking teeth (46*b*, 48*b*) or (104*a*, 104*b*), a slider (46*a*; 48*a*), a clasp (102*a*, 102*b*), a receiver (113), a catch (102*a*; 102*b*) a zipper (46; 48), an interlocking track (108*a*) and groove (108*b*), a ratchet (112), teeth (110*a*) engageable with a pawl (110*b*), a pawl (110*b*) insertable into delimited open spaces (110*c*), hooks (62*a*) which couple to loops (62*b*), interlocking ridges (106*a*, 106*b*), and combinations thereof. The adjuster (46, 48, 50) can be a fastener (46, 48, 50). The fastener can be a holdfast (46, 48, 50). The fastener and holdfast of the first receiver (34) can couple a first portion (34*a*) of the first receiver (34) to a second portion (34*b*) of the first receiver. The fastener and holdfast of the second receiver (36) can couple a first portion (36*a*) of the second receiver to a second portion (36*b*) of the second receiver. The fastener and holdfast of the housing (32) can couple a first portion (32*a*) of the housing to a second portion (32*b*) of the housing (32).

In the present example the adjuster (46, 48) of the first (34) and second receiver (36) each have a slider (46*a*, 48*a*) and teeth (46*b*, 48*b*) which interlock. Each slider (46*a*, 48*a*) moveable relative to its plurality of teeth in a first direction (51) to interlock the teeth (46*b*, 48*b*) and in a second direction (52) to unlock said teeth (46*b*, 48*b*). Alternatively, each adjuster (46, 48) can include a slider and a track and groove (108*a*, 108*b*). Each slider moveable relative to its track and groove in a first direction (51) to interlock the track and groove (108*a*, 108*b*) and in a second direction (52) to unlock the track and groove. The adjuster (46, 48) of the first (34) and second (36) receiver can each further include a respective strap (62) and loop (64) to further place its respective receiver in a fixedly coupled orientation. The strap (62) can have hooks (62*a*) and loops (62*b*) to fix the strap into a tightened end orientation. The adjusters (46, 48) of the first and second receivers can share structure. The adjuster (50) of the housing can comprise sliders (46*a*, 48*a*) and interlocking teeth (46*b*, 48*b*). The adjuster of the housing can also comprise sliders and a track and groove. The sliders of the housing can be shared with the adjusters of the first and second receivers. Further the connector housing (32) can comprise reinforcement (33) formed with an interior hardened material to prevent crush of the connectors. It can be hard-hat type material.

The first receiver (34), second receiver (36) and connector housing (32) can each comprise an adjustable band (116). The contact surface (45, 47) of the first (34) and second (36) receiver can comprise an interior surface of its respective adjustable band. The interior surface of each adjustable band can delimit a hollow of each adjustable band. Each hollow having and adjustable volume. The adjustors (46, 48, 50) of each of the first (34) and second (36) receivers and housing (32) can enable the adjustable volume.

The retainer can include a first seal (57) and a second seal (59). The first seal (57) can be configured to removably and fixedly couple to the first cord portion (40). The first cord portion (40) resides in a hollow delimited by the first seal (57). The contact surface (45) of the first receiver (34) can be disposed about the first seal (57). The second seal (59) can be configured to removably and fixedly couple to the second cord portion (42). The second cord portion (42) resides in a hollow delimited by the second seal (59). The contact surface (47) of the second receiver (36) can be disposed about the second seal (59). The contact surface (45) of the first receiver (34) and the contact surface (47) of the second receiver (36) can each interlock with its respective seal (57, 59). The contact surface (45, 47) of each of the first and second receiver (34, 36) can comprise a surface of a respective ridge or a plurality of respective ridges and grooves. The ridge or ridges of each seal (57, 59) can interlock with the ridge or ridges of its respective receiver (34, 36). Each seal (57, 59) cooperates with its respective receiver (34, 36) to keep its respective receiver (34, 36) in its fixedly coupled orientation. Each seal (57, 59) also helps resist the incursion of water in the housing chamber (31).

When the retainer (30) resides in the installed orientation, the connector housing (32), first receiver (34) and second receiver (36) are disposed about the first (38) and second (41) cord. The connector housing (32) resides disposed about and envelopes the first connector (39) plugged into or with the second connector (43). The connector housing (32) can be a jacket. The first receiver (34) resides about and envelopes the first cord portion (40). The second receiver (36) resides about and envelopes the second cord portion (42). The connector housing (32) can comprise a jacket. The first receiver (34) and second receiver (36) can each comprise a respective cord portion housing. Each respective cord portion housing (34, 36) can comprise a jacket. The connector housing (32) and cord portion housings (34, 36) can form a continuous, unitary, and integrated housing. The connector housing (32) and first (34) and second receiver (36) can comprise a continuous, unitary, and integrated jacket.

The contact surface (45, 47) of the first (34) and second (36) receiver can be rubber and tactile. The continuous, unitary, and integrated jacket and housing (32, 34, 36) can comprise an elastomeric material which can be rubber. The continuous, unitary, and integrated jacket and housing (32, 34, 36) can be resiliently deformable and flexible. The continuous jacket and housing (32, 34, 36) as well as the connector housing (32), first receiver (34) and second receiver (36) can comprise non-rigid material. The non-rigid material, continuous housing and jacket (32, 34, 36), as well as the connector housing (32), first receiver (34) and second receiver (36), can all be hand deformable and scrunchable into a deformed or scrunchable shape different from the shape when the retainer (30) resides in the installed orientation and at rest. The deformed or scrunched shape achieved without damaging the retainer (30). The non-rigid material, continuous housing and jacket (32, 34, 36), as well as the connector housing (32), first receiver (34), and second receiver (36) reformable and unscrunchable from the deformed and scrunched shape into the shape when the retainer resides in the installed orientation and at rest. The continuous housing and jacker (32, 34, 36) can be without an opening therethrough when the retainer resides in said installed orientation. The retainer (30), including the continuous jacket and housing (32, 34, 36), remains continuous, unitary, and integrated during installation of the retainer (30) on the first (40) and second (42) cord portion and removal of the retainer (30) from the first and second cord portion. The installation and removal without tools.

The retainer (30) can resist unplugging (decoupling) of said first connector (39) from the second connector (43) of when the retainer subjected to at least three (3) pounds, at least five (5), at least seven (7), at least ten (10) pounds, and at least fifteen (15) pounds of force applied through said first cord (38) or said second cord (41) to the retainer (30) in a decoupling direction (52). The first and second cords (38, 41) can be electrical cords, said first connector (39) can be a male connector, and the second connector (43) can be a female connector. The first connector can comprise a plurality of conductors.

In addition to the above in the retainer installed orientation, the first receiver (34), second receiver (36), and connector housing (32) each delimit a chamber (31). The first connector (39) plugged with, more particularly plugged into, the second connector (43) resides in the chamber (31). The first connector (39) fixedly resides in the chamber (31). The second connector (43) fixedly resides in the chamber (31). The first receiver (34) about the first connector; and the second receiver (36) about the second connector. The retainer (30) resists unplugging of the first connector (39) from the second connector (43). The retainer (30) also resists the incursion of water into the chamber (31) and generally weatherproofs the connectors (39, 43) from the elements. The retainer in this case can envelope the connectors (39, 43). The retainer can be a jacket, flexible, scrunchable, continuous, and elastomeric. The retainer can be without opening when in the installed orientation. The retainer can comprise rubber.

The stress relief at the connector comprises, for the purposes of this disclosure, both or either of the cord portion and connector of a cord such as a power cord. The cords (38, 41) can be off the shelf and have standard dimensions.

As can be easily understood from the foregoing, the basic concepts of the present invention may be embodied in a variety of ways. The invention involves numerous and varied embodiments of a retainer and methods for making and using the retainer.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "connector" should be understood to encompass disclosure of the act of "connecting"—whether explicitly discussed or not—and, conversely, were there effectively disclosure of the act of "connecting", such a disclosure should be understood to encompass disclosure of a "connector" and even a "means for connecting". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the retainers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice versa as necessary to define the matter for which protection is sought by this application or by any subsequent application or continuation, division, or continuation in part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation in part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A retainer to resist decoupling of a first connector of a first cord from a second connector of a second cord, said retainer comprising:

a first receiver having a contact surface and an adjuster in cooperation enabling adjustment of said first receiver from an uncoupled orientation into a fixedly coupled orientation with said first cord;

a second receiver having a contact surface and an adjuster in cooperation enabling adjustment of said second receiver from and uncoupled orientation into a fixedly coupled orientation with said second cord;

wherein said first receiver connected to said second receiver;

wherein said adjuster of said first receiver and said adjuster of said second receiver each comprises an adjustable band;

wherein said retainer when in an installed orientation, said first receiver resides in said fixedly coupled orientation with said first cord, said first cord resides in said first receiver;

said second receiver resides in said fixedly coupled orientation with said second cord, said second cord resides in said second receiver;

said first and second connector coupled together; and said retainer resists decoupling of said first connector from said second connector.

2. The retainer of claim 1, further comprising a first seal, wherein when said retainer in said installed orientation, said first cord in a space delimited by said first seal, said contact surface of said first receiver disposed about said first seal.

3. The retainer of claim 1, wherein said retainer removably couplable to said first and second cord.

4. The retainer of claim 1, wherein said retainer resists decoupling of said first connector of said first cord from said second connector of said second cord when said retainer subjected to three (3) pounds of force applied through said first cord or said second cord to said retainer in a decoupling direction.

5. The retainer of claim 1, wherein said retainer resists decoupling of said first connector of said first cord from said second connector of said second cord when said retainer subjected to five (5) pounds of force applied through said first cord or said second cord to said retainer in a decoupling direction.

6. The retainer of claim 1, wherein said first and second cords comprise electrical cords, said first connector comprises a male connector, and said second connector comprises a female connector.

7. The retainer of claim 1, wherein said adjuster of said first receiver and said adjuster of said second receiver each comprises a fastener, said fastener of said first receiver couples a first portion of said first receiver to a second portion of said first receiver; said fastener of said second receiver couples a first portion of said second receiver to a second portion of said second receiver.

8. The retainer of claim 7, wherein said fastener of each of said first receiver and second receiver each comprises a holdfast.

9. The retainer of claim 7, wherein said fastener to couple said first portion of said first receiver to said second portion of said first receiver and said fastener to couple said first portion of said second receiver to said second portion of said second receiver each having structure selected from a group of structures consisting of: a hook, a loop, a snap, a strap, interlocking ridges, a plurality of interlocking teeth, a slider, a clasp, a zipper, an interlocking track and groove, a ratchet, teeth engageable with a pawl, a pawl insertable into delimited open spaces, hooks which couple to loops, interlocking ridges, and combinations thereof.

10. The retainer of claim 1, wherein said adjuster of said first receiver and said adjuster of said second receiver each having structure selected from a group of structures consisting of: a hook, a loop, a snap, a strap, interlocking ridges, a plurality of interlocking teeth, a slider, a clasp, a zipper, an interlocking track and groove, a ratchet, teeth engageable with a pawl, a pawl insertable into delimited open spaces, hooks which couple to loops, interlocking ridges, and combinations thereof.

11. The retainer of claim 10, wherein said adjuster of said first receiver and said adjuster of said second receiver share structure.

12. The retainer of claim 10, wherein a housing to receive said first and second connectors interconnects said first receiver to said second receiver.

13. The retainer of claim 10, wherein said housing between said first receiver and second receiver.

14. The retainer of claim 13, wherein said housing includes an adjuster having structure selected from a group of structures consisting of: a hook, a loop, a snap, a strap, interlocking ridges, a plurality of interlocking teeth, a slider, a clasp, a zipper, an interlocking track and groove, a ratchet, teeth engageable with a pawl, a pawl insertable into delimited open spaces, hooks which couple to loops, and combinations thereof.

15. The retainer of claim 13, wherein said housing comprises a jacket.

16. A retainer to resist decoupling of a first connector of a first cord from a second connector of a second cord, said retainer comprising:

a first receiver having a contact surface and an adjuster in cooperation enabling adjustment of said first receiver from an uncoupled orientation into a fixedly coupled orientation with said first cord;

a second receiver having a contact surface and an adjuster in cooperation enabling adjustment of said second receiver from and uncoupled orientation into a fixedly coupled orientation with said second cord;

wherein said first receiver connected to said second receiver;

wherein said adjuster of said first receiver and said adjuster of said second receiver each comprises a fastener, said fastener of said first receiver couples a first portion of said first receiver to a second portion of said first receiver; said fastener of said second receiver couples a first portion of said second receiver to a second portion of said second receiver;

wherein said fastener of said first receiver and said fastener of second receiver each comprises a structure selected from a group of structures consisting of 1) a slider moveable relative to a plurality of teeth in a first direction to interlock said teeth and in a second direction to unlock said teeth and 2) a slider moveable relative to a track and groove in a first direction to interlock said track and groove and in a second direction to unlock said track and groove; and wherein said retainer when in an installed orientation, said first receiver resides in said fixedly coupled orientation with said first cord, said first cord resides in said first receiver;

said second receiver resides in said fixedly coupled orientation with said second cord, said second cord resides in said second receiver;

said first and second connector coupled together; and said retainer resists decoupling of said first connector from said second connector.

17. A retainer to resist decoupling of a first connector of a first cord from a second connector of a second cord, said retainer comprising:

a first receiver having a contact surface and an adjuster in cooperation enabling adjustment of said first receiver from an uncoupled orientation into a fixedly coupled orientation with said first cord;

a second receiver having a contact surface and an adjuster in cooperation enabling adjustment of said second receiver from and uncoupled orientation into a fixedly coupled orientation with said second cord;

wherein said first receiver connected to said second receiver;

wherein said adjuster of said first receiver comprises a structure selected form a group of structures consisting of 1) a slider moveable relative to a plurality of teeth in a first direction to interlock said teeth and a second direction to unlock said teeth and 2) a slider moveable relative to a track and a groove in a first direction to interlock said track and groove and a second direction to unlock said track and groove; and wherein said retainer when in an installed orientation, said first receiver resides in said fixedly coupled orientation with said first cord, said first cord resides in said first receiver;

said second receiver resides in said fixedly coupled orientation with said second cord, said second cord resides in said second receiver;

said first and second connector coupled together; and said retainer resists decoupling of said first connector from said second connector.

* * * * *